US009388710B2

(12) United States Patent
Rai et al.

(10) Patent No.: US 9,388,710 B2
(45) Date of Patent: Jul. 12, 2016

(54) EXHAUST DIFFUSER ARRANGEMENT FOR A TURBINE SYSTEM AND METHOD OF REDIRECTING A FLOW

(71) Applicant: General Electric Company, Schenectady, NY (US)

(72) Inventors: Sachin Kumar Rai, Jharkhand (IN); Richa Awasthi, Karnataka (IN); Shruti Kulkarni, Karnataka (IN); Moorthi Subramaniyan, Karnataka (IN)

(73) Assignee: General Electric Company, Schenectady, NY (US)

( * ) Notice: Subject to any disclaimer, the term of this patent is extended or adjusted under 35 U.S.C. 154(b) by 863 days.

(21) Appl. No.: 13/632,752

(22) Filed: Oct. 1, 2012

(65) Prior Publication Data

US 2014/0093352 A1 Apr. 3, 2014

(51) Int. Cl.
*F01D 25/30* (2006.01)

(52) U.S. Cl.
CPC ..... *F01D 25/30* (2013.01)

(58) Field of Classification Search
CPC ..... F01D 25/30; F01D 25/305; F01D 25/28; F01D 9/02; F01D 1/023; F01D 5/145; F05D 2240/126; F05D 2270/17
See application file for complete search history.

(56) References Cited

U.S. PATENT DOCUMENTS

| | | | | |
|---|---|---|---|---|
| 4,007,587 | A * | 2/1977 | Banthin et al. | 60/204 |
| 5,813,828 | A * | 9/1998 | Norris | 415/115 |
| 7,707,834 | B2 | 5/2010 | Cayre et al. | |
| 2002/0127100 | A1 | 9/2002 | Kreitmeier | |

* cited by examiner

*Primary Examiner* — Christopher Verdier
*Assistant Examiner* — Juan G Flores
(74) *Attorney, Agent, or Firm* — Fletcher Yoder, P.C.

(57) ABSTRACT

An exhaust diffuser arrangement for a turbine system includes an inlet for receiving a flow proximate a last stage bucket of the turbine system, the flow flowing in a first flow direction. Also included is a flow redirecting component. The flow redirecting component includes a first wall having a first side of a concave surface geometry for redirecting the flow and a second side of a convex surface geometry. The flow redirecting component also includes a second wall spaced downstream of the first wall and having at least one flow exit for reducing a boundary layer along the second side of the first wall.

20 Claims, 2 Drawing Sheets

EXHAUST DIFFUSER ARRANGEMENT FOR A TURBINE SYSTEM AND METHOD OF REDIRECTING A FLOW

BACKGROUND OF THE INVENTION

The subject matter disclosed herein relates to turbine systems, and more particularly to an exhaust diffuser for such turbines systems, as well as a method of redirecting a flow within the exhaust diffuser.

Turbine systems often include an exhaust diffuser that reduces the speed of a flow within the turbine system prior to expelling the flow into the atmosphere or another turbine system component and to recover pressure therein. In an effort to reduce the axial dimension of the turbine system, aggressive exhaust diffuser designs have been implemented with a high turn angle that the flow is routed through.

One consequence of a high turn angle for the exhaust diffuser is flow separation proximate at least a portion of a casing wall that defines a duct through which the flow travels, thereby hindering the ability of the exhaust diffuser to reduce the speed of the flow and recover pressure within the duct prior to expulsion. In an effort to overcome the issues related to the high turn angle, while still reducing the axial dimension of the exhaust diffuser, structures such as guide vanes have been introduced into the duct of the exhaust diffuser to more rapidly redirect the flow with an upstream surface, however, flow separation proximate the downstream surface of the structure is typically exhibited, leading to issues similar to those discussed above with respect to flow separation proximate the casing.

BRIEF DESCRIPTION OF THE INVENTION

According to one aspect of the invention, an exhaust diffuser arrangement for a turbine system includes an inlet for receiving a flow proximate a last stage bucket of the turbine system, the flow flowing in a first flow direction. Also included is a flow redirecting component. The flow redirecting component includes a first wall having a first side of a concave surface geometry for redirecting the flow and a second side of a convex surface geometry. The flow redirecting component also includes a second wall spaced downstream of the first wall and having at least one flow exit for reducing a boundary layer along the second side of the first wall.

According to another aspect of the invention, an exhaust diffuser arrangement for a turbine system includes a diffuser duct having an inlet for receiving a flow in a first flow direction and an outlet configured to expel the flow in a second flow direction. Also included is a flow redirecting component disposed within the diffuser duct. The flow redirecting component includes a first end proximate the inlet, the first end comprising an opening for receiving the flow. The flow redirecting component also includes a first wall extending from the first end to a second end. The flow redirecting component further includes a second wall spaced downstream from the first wall and extending from the first end to the second end, the first wall and the second wall operably coupled at the second end, wherein the second wall includes at least one flow exit.

According to yet another aspect of the invention, a method of redirecting a flow within an exhaust diffuser is provided. The method includes routing a flow in a first flow direction to an inlet of the exhaust diffuser. Also included is redirecting the flow along a first side of a first wall of a flow redirecting component. Further included is injecting a portion of the flow into a cavity defined by the first wall and a second wall spaced downstream of the first wall. Yet further included is expelling the portion of the flow through at least one flow exit formed in the second wall, thereby reducing a boundary layer along a second side of the first wall.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
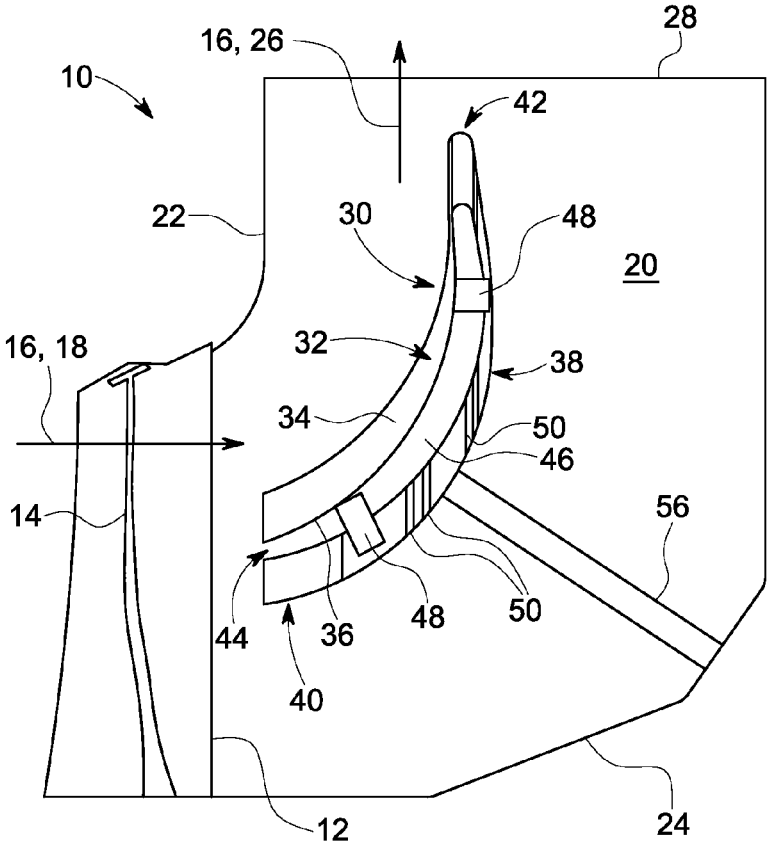
FIG. 1 is an elevational side view of an exhaust diffuser arrangement having a flow redirecting component for a turbine system.
Figure 2:
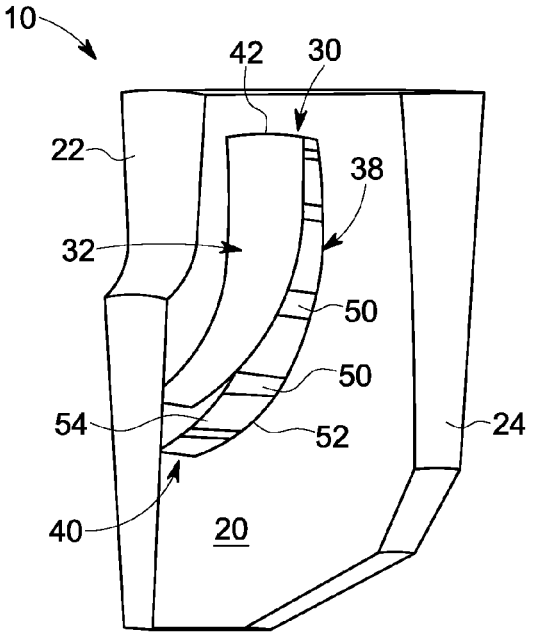
FIG. 2 is a perspective view of the flow redirecting component within the exhaust diffuser arrangement.
Figure 3:
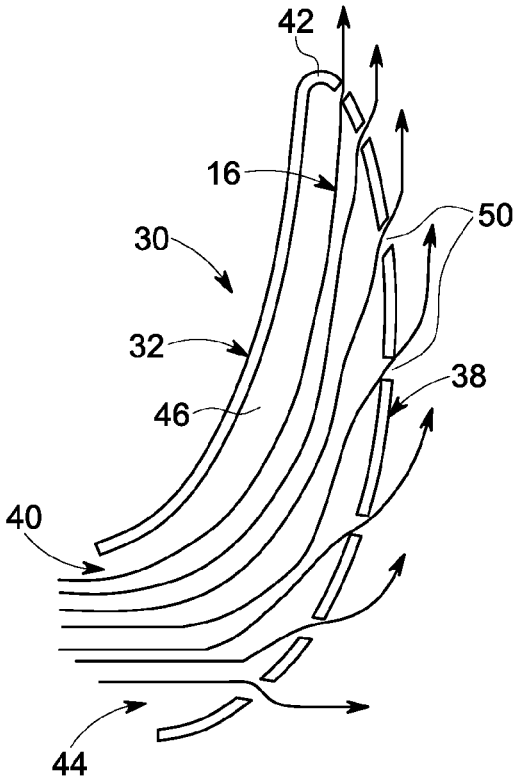
FIG. 3 is a side, cross-sectional view of the flow redirecting component.

Referring to FIGS. 1-3, an exhaust diffuser arrangement is illustrated and generally referred to with numeral 10. The exhaust diffuser arrangement 10 may be employed in a variety of applications, such as a variety of turbine systems (not illustrated). Applications contemplated include axial or radial exhaust diffusers for a gas turbine system, as well as a steam turbine application, such as a low pressure split flow steam turbine, but it is to be appreciated that any exhaust system may benefit from implementation of the exhaust diffuser arrangement 10 described herein.

The exhaust diffuser arrangement 10 includes an inlet 12 that is located proximate a last stage bucket 14 for receiving a flow 16 of fluid traveling at a relatively high velocity in a first flow direction 18, such as a predominantly axial direction, however, it is to be understood that the characterization of an axial direction of flow is merely illustrative and not limiting of the direction of travel of the flow 16. The exhaust diffuser arrangement 10 includes a diffuser duct 20 that may be formed of various cross-sectional geometries and is defined by at least one casing wall that includes a radially inner wall portion 22 and a radially outer wall portion 24. Irrespective of the precise cross-sectional geometry of the diffuser duct 20, the diffuser duct 20 is shaped to rapidly transition the flow 16 from the first flow direction 18 to a second flow direction 26 toward an outlet 28 of the exhaust diffuser arrangement 10. The second flow direction 26 may be aligned at numerous angles relative to the first flow direction 18, and in one exemplary embodiment the second flow direction 26 is relatively radial and approximately perpendicular to the first flow direction 18.

To reduce flow separation between the flow 16 and the radially outer wall portion 24 caused by rapid turning of the flow 16 from the first flow direction 18 to the second flow direction 26, a flow redirecting component 30 is disposed within the diffuser duct 20. The flow redirecting component 30 includes a first wall 32 having a first side 34 and a second side 36. The first side 34 is upstream of the second side 36 and is shaped to facilitate rapid redirecting of the flow 16. The shape of the first side 34 may be referred to as having a relatively concave surface geometry. Conversely, the second side 36 of the first wall 32 is of a generally convex surface geometry. A second wall 38 is positioned in close proximity to the first wall 32 and is disposed at a downstream location relative to the first wall 32.

Both the first wall 32 and the second wall 38 extend from a first end 40 of the flow redirecting component 30 to a second end 42 of the flow redirecting component 30, with the first end 40 being closer in proximity to the inlet 12 of the exhaust diffuser arrangement 10 than the second end 42. The first end 40 includes an opening 44 formed between the first wall 32 and the second wall 38 and is configured to ingest a portion of the flow 16 into a cavity 46 defined by the first wall 32 and the second wall 38. It is to be appreciated that the spacing between the first wall 32 and the second wall 38 may vary along the length of the first wall 32 and the second wall 38, as it is contemplated that the first wall 32 and the second wall 38 are operably coupled, or integrally formed, proximate the second end 42 of the flow redirecting component 30. Maintenance of the spacing between the first wall 32 and the second wall 38 may be optionally achieved by the disposition of at least one rib 48 disposed within the cavity 46 to apply a force upon the second wall 38 and the second side 36 of the first wall 32.

The second wall 38 includes at least one, but typically a plurality of flow exits 50 extending completely through the second wall 38, thereby providing an exit path for the flow 16 from the cavity 46. The plurality of flow exits 50 may be of various shapes, and in one exemplary embodiment, the plurality of flow exits 50 extend from a first edge 52 of the second wall 38 to a second edge 54 of the second wall 38. In such an embodiment, the plurality of flow exits 50 may be positioned relatively parallel to one another. Alternatively, the plurality of flow exits 50 may comprise smaller apertures arranged in any number of patterns along the second wall 38.

It is to be appreciated that the exhaust diffuser arrangement 10 may include a plurality of flow redirecting components. Irrespective of the number of flow redirecting components, the flow redirecting component 30 may be disposed at numerous locations within the diffuser duct 20, with the first end 40 typically being in close proximity to the inlet 12. Irrespective of the precise location of the flow redirecting component 30 within the diffuser duct 20, at least one strut 56 may be employed to secure the flow redirecting component 30. The at least one strut 56 is operably coupled to, or integrally formed with, the flow redirecting component 30 and at least one of the radially inner wall portion 22 and the radially outer wall portion 24. It is contemplated that a plurality of struts may be included to provide added structural integrity, with the precise number depending on the application of use. The at least one strut 56 may be of varying cross-sections, including circular.

In operation, the flow redirecting component 30 assists in rapidly transitioning the flow 16 from the first flow direction 18 to the second flow direction 26. Specifically, the first side 34 of the first wall 32 facilitates turning of the flow 16. The second wall 38, and the cavity 46 formed between the first wall 32 and the second wall 38, reduces flow separation at regions proximate the second side 36 of the first wall 32 by energizing a boundary layer present along the second side 36. Alternatively, or in combination with energizing the boundary layer with the cavity 46, reduction of flow separation proximate the second side 36 of the first wall 32 may be achieved by incorporating one or more suction components to energize the boundary layer. Advantageously, the effective rapid turning of the flow 16 allows for reduction of the overall exhaust diffuser arrangement 10 axial length.

Figure 4:
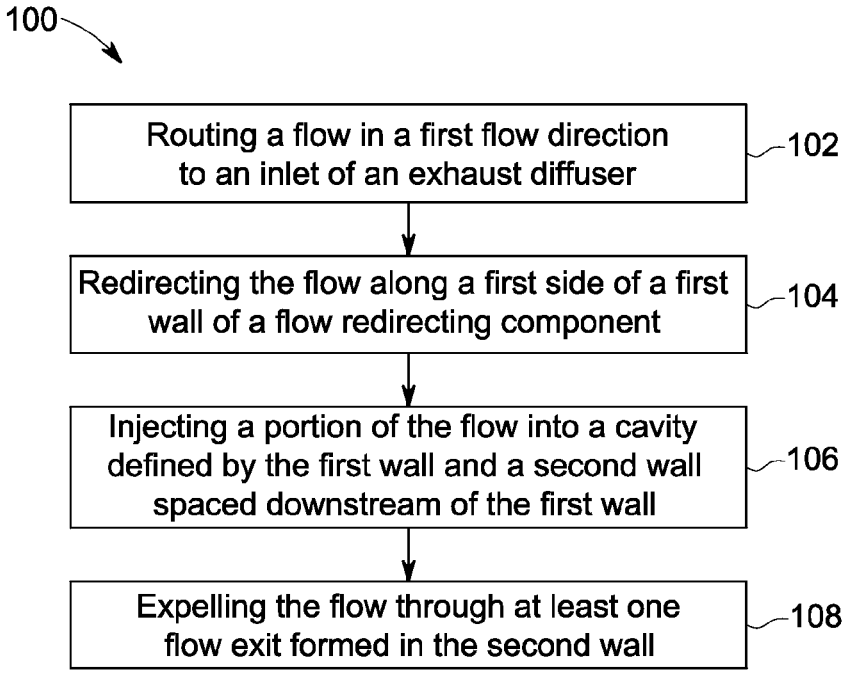
FIG. 4 is a flow diagram illustrating a method of redirecting a flow within the exhaust diffuser arrangement.

As illustrated in the flow diagram of FIG. 4, and with reference to FIGS. 1-3, a method of redirecting a flow within an exhaust diffuser 100 is also provided. The exhaust diffuser arrangement 10 has been previously described and specific structural components need not be described in further detail. The method of redirecting a flow within an exhaust diffuser 100 includes routing a flow in a first flow direction to an inlet of the exhaust diffuser 102. The flow is redirected along a first side of a first wall of a flow redirecting component 104, with a portion of the flow injected into a cavity defined by the first wall and a second wall spaced downstream of the first wall 106. The portion of the flow is expelled through at least one flow exit formed in the second wall 108 to reduce the boundary layer along a second side 36 of the first wall 32.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An exhaust diffuser arrangement for a turbine system comprising:

an inlet for receiving a flow proximate a last stage bucket of the turbine system, the flow flowing in a first flow direction; and a flow redirecting component comprising:

a first wall having a first side of a concave surface geometry for redirecting the flow and a second side of a convex surface geometry;

a second wall spaced downstream of the first wall and having at least one flow exit for reducing a boundary layer along the second side of the first wall;

a cavity defined by the first wall and the second wall; and an upstream end comprising an opening, wherein the opening is configured to direct a portion of the flow into the cavity.

2. The exhaust diffuser arrangement of claim 1, wherein an axis of the opening is parallel to the first flow direction.

3. The exhaust diffuser arrangement of claim 1, wherein the first wall and the second wall are operably coupled proximate a second end of the flow redirecting component.

4. The exhaust diffuser arrangement of claim 1, wherein the first wall and the second wall are integrally formed proximate a second end of the flow redirecting component.

5. The exhaust diffuser arrangement of claim 1, wherein the second wall comprises a plurality of flow exits spaced along the second wall.

6. The exhaust diffuser arrangement of claim 1, wherein the at least one flow exit extends from a first edge of the second wall to a second edge of the second wall.

7. The exhaust diffuser arrangement of claim 1, the flow redirecting component further comprising at least one rib disposed between the first wall and the second wall for spacing therebetween.

8. The exhaust diffuser arrangement of claim 1, further comprising at least one strut extending from at least one of an inner wall and an outer wall of the exhaust diffuser arrangement to the flow redirecting component for supporting the flow redirecting component.

9. The exhaust diffuser arrangement of claim 1, wherein the first wall redirects the flow toward a second flow direction that is relatively perpendicular to the first flow direction.

10. An exhaust diffuser arrangement for a turbine system comprising:

a diffuser duct having an inlet for receiving a flow in a first flow direction and an outlet configured to expel the flow in a second flow direction; and a flow redirecting component disposed within the diffuser duct, the flow redirecting component comprising:

a first end proximate the inlet, the first end comprising an axial opening for receiving a portion of the flow;

a first wall extending from the first end to a second end; and a second wall spaced downstream from the first wall and extending from the first end to the second end, the first wall and the second wall operably coupled at the second end, the second wall includes at least one flow exit.

11. The exhaust diffuser arrangement of claim 10, wherein the first wall and the second wall are integrally formed proximate the second end.

12. The exhaust diffuser arrangement of claim 10, wherein the second wall comprises a plurality of flow exits spaced along the second wall.

13. The exhaust diffuser arrangement of claim 10, wherein the at least one flow exit extends from a first edge of the second wall to a second edge of the second wall.

14. The exhaust diffuser arrangement of claim 10, the flow redirecting component further comprising at least one rib disposed between the first wall and the second wall for spacing therebetween.

15. The exhaust diffuser arrangement of claim 10, further comprising at least one strut extending from at least one of an inner wall and an outer wall of the exhaust diffuser arrangement to the flow redirecting component for supporting the flow redirecting component.

16. The exhaust diffuser arrangement of claim 10, wherein the first flow direction and the second flow direction are relatively perpendicular to each other.

17. A method of redirecting a flow within an exhaust diffuser comprising:

routing a flow in a first flow direction to an inlet of the exhaust diffuser;

redirecting the flow along a first side of a first wall of a flow redirecting component;

injecting a portion of the flow into an opening of a cavity defined by a first upstream end of the first wall and a second upstream end of a second wall spaced downstream of the first wall; and expelling the portion of the flow through at least one flow exit formed in the second wall, thereby reducing a boundary layer along a second side of the first wall.

18. The method of claim 17, wherein redirecting the flow comprises turning the flow from the first flow direction to a second flow direction relatively perpendicular to the first flow direction.

19. The method of claim 17, wherein the second wall is spaced from the first wall by at least one rib disposed within the cavity between the first wall and the second wall.

20. The method of claim 17, wherein the second wall comprises a plurality of flow exits aligned relatively parallel to each other for expelling the portion of the flow from the cavity.

* * * * *